US007915510B2

(12) United States Patent
Ueno et al.

(10) Patent No.: US 7,915,510 B2
(45) Date of Patent: Mar. 29, 2011

(54) TUNER FOR MUSICAL INSTRUMENTS AND AMPLIFIER WITH TUNER

(75) Inventors: Masato Ueno, Hamamatsu (JP); Kosuke Takata, Hamamatsu (JP); Yoshinobu Morimoto, Hamamatsu (JP)

(73) Assignee: Roland Corporation, Hamamatsu, Shizuoka-ken (JP)

( * ) Notice: Subject to any disclaimer, the term of this patent is extended or adjusted under 35 U.S.C. 154(b) by 679 days.

(21) Appl. No.: 11/858,065

(22) Filed: Sep. 19, 2007

(65) Prior Publication Data

US 2008/0072739 A1 Mar. 27, 2008

(30) Foreign Application Priority Data

Sep. 21, 2006 (JP) ..... 2006-256124

(51) Int. Cl.
*G10G 7/02* (2006.01)

(52) U.S. Cl. ..... 84/454; 84/615; 84/616; 84/653; 84/654

(58) Field of Classification Search ..... None
See application file for complete search history.

(56) References Cited

U.S. PATENT DOCUMENTS 3,144,802 A * 8/1964 Faber, Jr. et al. ..... 84/454
4,271,746 A * 6/1981 Dobbie ..... 84/454
4,429,609 A * 2/1984 Warrender ..... 84/454
4,796,509 A 1/1989 Mizuguchi et al.
5,056,398 A * 10/1991 Adamson ..... 84/454
5,549,028 A 8/1996 Steinberger
6,580,024 B2 * 6/2003 Skubic ..... 84/477 R
6,653,543 B2 11/2003 Kulas
6,953,885 B2 10/2005 Konishi
6,965,067 B2 11/2005 Kondo
6,969,797 B2 * 11/2005 Brinkman et al. ..... 84/625
7,030,311 B2 * 4/2006 Brinkman et al. ..... 84/625
7,049,502 B2 * 5/2006 Taku et al. ..... 84/454
7,285,710 B1 * 10/2007 Wallace ..... 84/454
2005/0087060 A1 * 4/2005 Taku et al. ..... 84/455
2006/0027074 A1 2/2006 Masuda et al.
2006/0236849 A1 10/2006 Yamada
2006/0288850 A1 12/2006 Okuyama
2007/0095196 A1 * 5/2007 Yagi et al. ..... 84/612
2008/0047414 A1 * 2/2008 Friedman et al. ..... 84/609
2008/0295672 A1 * 12/2008 Compton ..... 84/605

* cited by examiner

*Primary Examiner* — Marlon T Fletcher
(74) *Attorney, Agent, or Firm* — Foley & Lardner LLP

(57) ABSTRACT

A tuning device includes an input terminal configured to receive an input electrical signal and a pitch detector to detect a pitch of the input electrical signal. A manual pitch designator designates a standard pitch from pitches of a scale. An automatic pitch designator designates a standard pitch from a scale that is closest to the pitch of the input electrical signal. A mode selector selects either a manual mode where the standard pitch is designated by the manual pitch designator, or an auto mode where the standard pitch is designated by the automatic pitch designator. A pitch comparator compares the pitch of the input electrical signal and the standard pitch and a display device displays the results of the comparison. The display device is configured such that when the standard pitch is designated by the automatic pitch designator, the standard pitch is not displayed.

6 Claims, 3 Drawing Sheets

TUNER FOR MUSICAL INSTRUMENTS AND AMPLIFIER WITH TUNER

CROSS-REFERENCE TO RELATED PATENT APPLICATIONS

Japan Priority Application 2006-256124, filed Sep. 21, 2006 including the specification, drawings, claims and abstract, is incorporated herein by reference in its entirety.

BACKGROUND OF THE INVENTION

Embodiments of the present invention relate generally to a tuning device and method for musical instruments and an amplifier, in particular, that have a simple configuration and can be used to tune the pitch of the musical instruments.

For some time conventional tuners for musical instruments have been known that detect the pitch (frequency) of the vibration of a string belonging to a stringed instrument such as a guitar and display the deviation between the detected pitch and a standard pitch. These kinds of tuners are known to have a manual format in which the user designates the standard pitch, which is the pitch that it is desired to match. The difference between the pitch from the vibration of the string and the standard pitch is then displayed. These kinds of tuners are also known to have an auto format (also known as a chromatic format) in which, without the user designating a pitch to be matched, the tuner displays the letter notation for the detected pitch so the user can judge the fluctuation of the pitch that is to be matched by means of the display.

However, with a manual format tuner such as the one described in Japanese Published Patent Application No. 2004-53779, the user must set a standard pitch for each string, which can make tuning troublesome. In addition, an auto format tuner such as the one described in Japanese Patent Publication No. 3090987 needs to provide a display device that displays the letter notation or the string number corresponding to the detected pitch. The tuner requires space for the installation of these display devices.

SUMMARY OF THE INVENTION

Embodiments of the present invention relate to a tuning device and an amplifier for a musical instrument with which the tuning of the pitch of the musical instrument is possible using a simple configuration.

According to one embodiment of the present invention, a tuning device includes an input device configured for receiving an electrical signal and a pitch detection device that detects the pitch of the electrical signal. The tuning device further includes a manual pitch designation device with which it is possible to designate any of the pitches that make up the musical scale as the standard pitch. The tuning device further includes an auto pitch designation device with which the pitch that is closest to the detected pitch is designated as the standard pitch from among the pitches that make up the musical scale. The tuning device further includes a mode selection device that selects either one of the modes: a manual mode in which the standard pitch is designated by the manual pitch designation device and an automatic mode in which the standard pitch is designated by the auto pitch designation device. The tuning device further includes a comparison device, which compares the detected pitch and the standard pitch, and a display device that displays the result of the comparison. The display device is setup such that the standard pitch that has been designated by the previously mentioned auto pitch designation means is not displayed. Accordingly, it is possible to tune the pitch of the musical instrument with a simple configuration. In other words, a display system that displays the letter notation is not necessary. Therefore, the display means can be installed even in those cases where the space on the operation panel is small.

In the auto mode, if the letter notation that has been selected as the standard pitch is not displayed, it may not be clear what the pitch is being compared to and it is difficult to carry out the tuning. Once the tuning is done, there are no great changes, and it becomes unnecessary to display the letter notation. However, in the case of stringed instruments, when the strings are changed the standard pitch may not be clear making tuning difficult. In those cases, the standard pitch is designated in the manual mode and the tuning is done. After the tuning is carried out, the string may become slack and the pitch may become slightly low, so the auto mode is set and it is then possible to carry out the tuning without selecting the standard pitch. Since the manual mode is only selected when the string has been restrung and after that it is possible to use the auto mode to carry out the tuning without the manual selection of the standard pitch, the tuner is easy to use. Accordingly, there is no need to furnish a display system that displays the letter notation and it is possible to make the configuration simple.

According to an example embodiment of the present invention the standard pitch designated by the manual pitch designation device corresponds to the pitch of an open string of a stringed instrument. This is convenient for the tuning of stringed instruments.

Further, the standard pitch designated by the manual pitch designation device may correspond to a string number that corresponds to the pitch of an open string of a stringed instrument. Accordingly, it is possible to carry out the tuning of the string even when the pitch of the open string is not known.

According to another example embodiment of the present invention, the standard pitch designated by the auto pitch designation device corresponds to an open string of a stringed instrument. Accordingly, in the auto mode, the standard pitch is a pitch that corresponds to the pitch of an open string that is more than a halftone away from the pitch of other open strings. Therefore, a user will not mistakenly tune to a pitch that differs by a halftone, making tuning easier.

Further, the standard pitch designated by the auto pitch designation device may correspond to a pitch of the chromatic scale. Accordingly, it is possible to tune to a standard pith that differs by a halftone. Therefore, adjustments can be a halftone at a time by viewing whether or not the display device matches or not while gradually changing the tension of the string.

In addition, the comparison device makes a determination as to whether the detected pitch is higher than, lower than, or matches the standard pitch that has been designated. Further, the display device then displays the results of the determination, and is set up such that the standard pitch that has been designated by the previously mentioned auto pitch designation means is not displayed. Accordingly, it is possible to form the display device inexpensively and, it can be installed even on a small operating panel.

In accordance with another embodiment of the present invention, the tuner is part of an amplifier for a musical instrument. The embodiment can be employed as both a tuner and as an amplifier. Accordingly, even in those cases where the operating panel is small such as in a small amplifier where there is no space for the installation of a display system that will display the letter notation, it is possible for the tuner of the present invention to be installed.

Additionally, the amplifier may include a function selection device, which selects either the tuner function, which detects the pitch of the electrical signal from the input device or the amplifier function, which amplifies and outputs the electrical signal from the input device. The amplifier further includes an operator, which manages the settings as desired. When the tuner function is selected, the operator designates the standard pitch as the manual pitch designation means. When the amplifier function is selected, the operator sets the type of timbre control used for processing the electrical signal. Accordingly, the operators that are used for the amplifier function also serve as the operators for the tuner function and it is possible to lower the number of operators to provide an amplifier at a low cost.

In another embodiment of the present invention, when the amplifier function is selected, the operator sets the type of control used to process the frequency characteristics of the electrical signal. Accordingly, it is possible for the user to set any frequency characteristics desired when using the amplifier function.

According to another embodiment of the present invention, when the amplifier function is selected, the operator sets a type of modeling that simulates characteristics of an instrument or a reproduction amplifier for processing the electrical signal. Accordingly, it is possible for the user to set any type of modeling desired when using the amplifier function.

In an additional embodiment of the present invention, when the amplifier function is selected, the operator sets the type of effect that is applied to the electrical signal. Accordingly, it is possible for the user to set any type of effect desired when using the amplifier function,

DETAILED DESCRIPTION OF THE PREFERRED EMBODIMENTS

Figure 1:
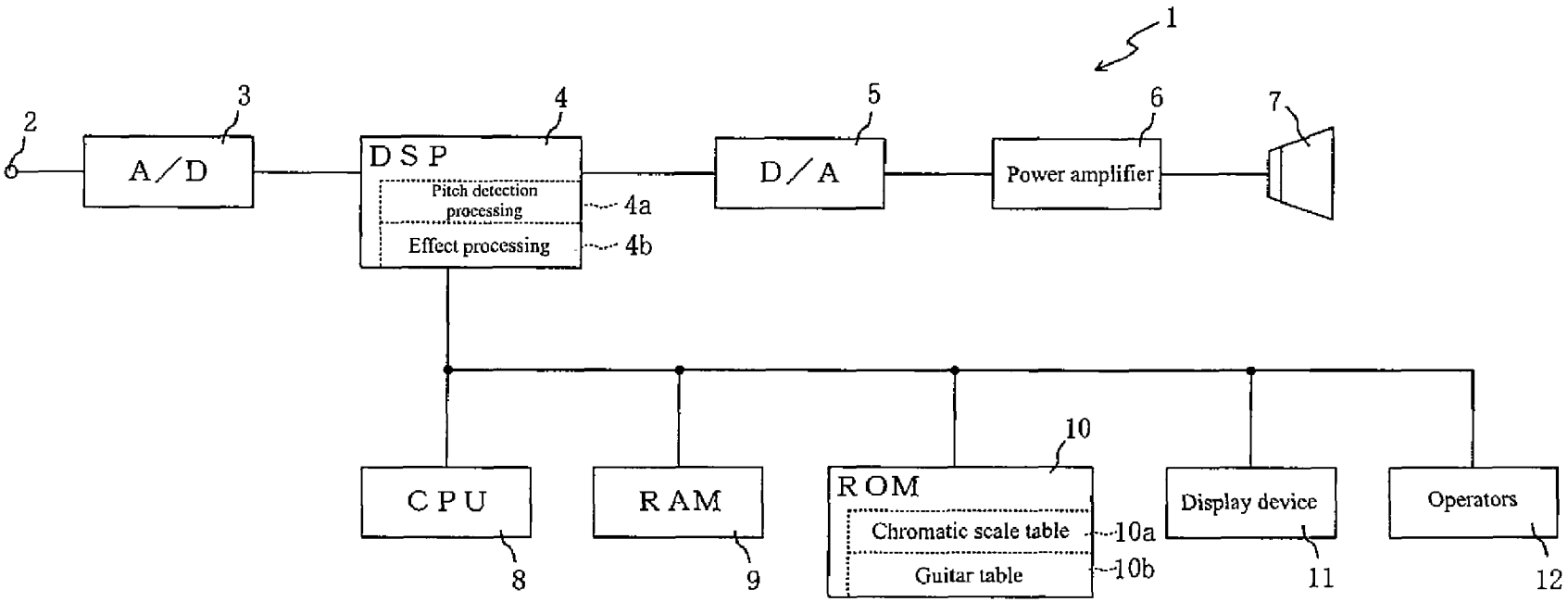
FIG. 1 is a block diagram of the electrical configuration of an embodiment of an amplifier for a musical instrument that has a tuner for a musical instrument installed.

An explanation will be given below regarding an example embodiment of the present invention while referring to the attached drawings. FIG. 1 is a block diagram that shows the electrical configuration of the amplifier 1, which has been famished with a tuner for a musical instrument of the present invention and is one example embodiment of the present invention. According to this embodiment, the amplifier 1 is furnished primarily with a tuner function that detects pitch of a sound that has been input, a simulation function that converts the electrical signal that has been input, and an effect application function that applies an effect (e.g. reverberation, etc.).

As shown in the embodiment in FIG. 1, the amplifier 1 is primarily furnished with an input terminal 2, an A/D converter 3, a DSP 4, a D/A converter 5, a power amplifier 6, a speaker 7, a CPU 8, a RAM 9, a ROM 10, a display device 11, and operators 12. Among these, the DSP 4, the CPU 8, the RAM 9, the ROM 10, the display device 11, and the operators 12 are mutually interconnected by a bus line 13.

The input terminal 2 may be formed using a jack or other suitable connection means and may be mounted such that the plug that forms the output terminal of the connecting cord from an electrical guitar pickup or a microphone can be freely inserted and removed. The electrical signal that has been input to the input terminal 2 is input to the A/D converter 3.

The A/D converter 3 samples the analog electrical signal that has been input at a specified sampling frequency (e.g. 44.1 kHz), quantifies this using a specified number of bits (e.g. 16 bits), and inputs the digital signal that has been converted to the DSP 4.

The DSP 4 is a digital signal processor and processes the digital signal that has been converted by the A/D converter 3. In this exemplary embodiment, either the tuner function or the amplifier function may be selected by the user and in those cases where the tuner function has been selected, the DSP 4 detects the zero cross of the waveform of the digital signal and informs the CPU 8. When the notification of the zero cross is input, the CPU 8 detects the period (i.e. the pitch) of the input signal based on the time interval that has been generated by the zero cross.

In those cases where the amplifier function has been selected, the DSP 4 converts the digital signal to the type of modeling that has been set by the user, applies effects (e.g. distortion, reverb, etc.) and outputs to the D/A converter 5. The DSP 4 stores a pitch processing program 4*a* for the detection of the pitch, an effect processing program 4*b* that converts the input signal or applies an effect to the input signal, and executes any programs in conformance with the instructions of the CPU 8.

The D/A converter 5 converts the digital signal that has been processed by the DSP 4 in the amplifier function to an analog electrical signal and outputs that analog electrical signal to the power amplifier 6. The power amplifier 6 amplifies the analog electrical signal and outputs the amplified signal to the speaker 7. The speaker 7 converts the amplified analog electrical signal into sound.

According to the described embodiment, the CPU 8 is an arithmetic processing unit and each of the various control programs that are executed by the CPU 8 as well as the fixed value data that are referred to at the time of execution are stored in the ROM 10. The chromatic scale table and the guitar table that are referred to in the tuner function may be stored as fixed value data. For the chromatic scale table, the pitches that correspond to each of the letter notations that comprise the chromatic scale (C, C#, D, D#, etc.) may be stored. For the guitar table, the open string pitches for each of the six strings of a guitar, and the pitches of the scale that are used for the so-called irregular tuning (A♭ and A♭♭) may be stored. The stored pitches, as the standard pitches, are compared with the pitch that has been detected by the DSP 4 when the tuner function is selected.

The RAM 9 is memory for the temporary storage of each of the various kinds of data at the time of the execution of the control programs by the CPU 8 and is configured to be rewritable.

Figure 2:
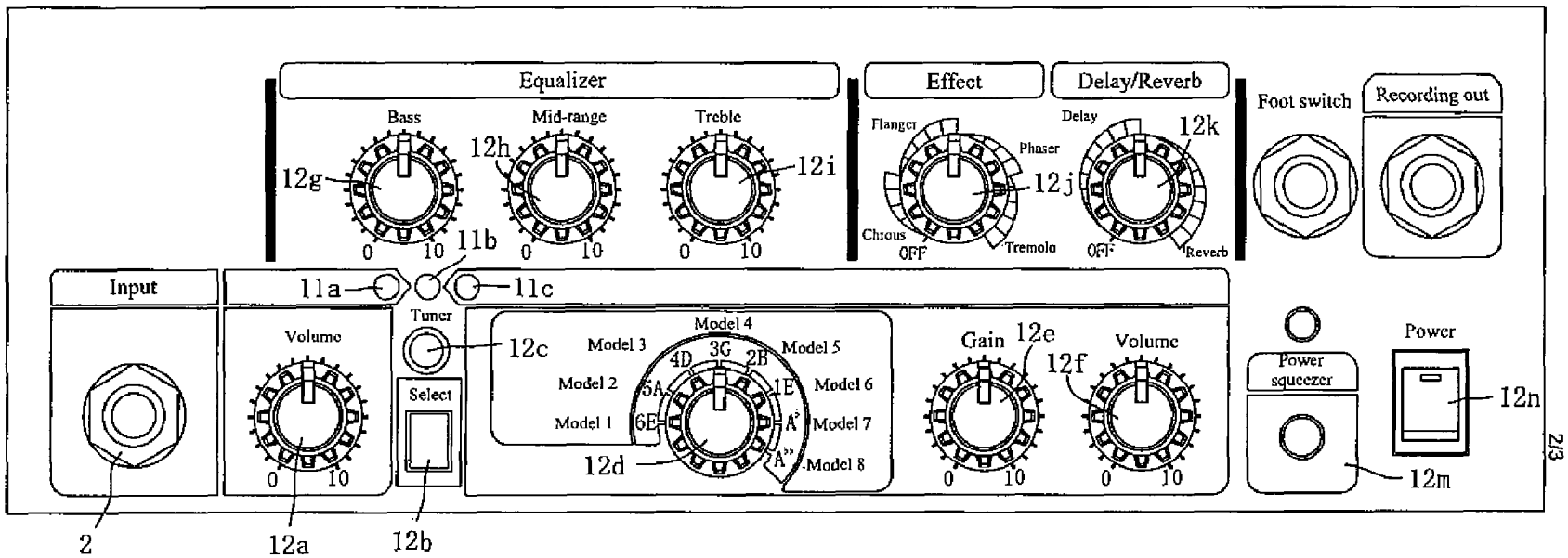
FIG. 2 is a planar drawing that shows an operating panel of an amplifier for a musical instrument according an embodiment of the present invention.

In the embodiment shown in FIG. 2, the display 11 comprises the three LEDs 11*a*, 11*b*, and 11*c*. Each of the operators 12 in one embodiment are either a rotary control or switch and are operated by the user. An explanation will be given next regarding the display 11 and the operators 12 while referring to FIG. 2, which shows the operating panel.

FIG. 2 is a planar drawing that shows an operating panel with which an exemplary embodiment of an amplifier for a musical instrument 1 is furnished. As is shown in FIG. 2, a plurality of rotary controls, a plurality of switches, a plurality of display devices, and a plurality of input and output terminals are arranged on the operating panel.

The amplifier for a musical instrument in this embodiment may be used with an electric guitar and is described as such. The amplifier may also be used with other instruments or sound generating devices. Classified broadly, there are the cases in which the electric guitar is used as the lead guitar and cases in which the electric guitar is used as the backing (second) guitar and it is possible to produce the optimum settings for each of the cases by switching using the switch 12*b*. The setting for a lead guitar is called the lead channel and the setting for a backing guitar is called the clean channel. In those cases where the clean channel has been selected, the LED 11*a* is lit, and in those cases where the lead channel has been selected, the LED 11*c* is lit. Incidentally, in the tuner function the LED 11*a*, LED 11*b*, and LED 11*c* display the deviation of the pitch that has been detected with respect to the standard pitch. In detail, the LED 11*a* indicates the fact that the detected pitch is lower than the standard pitch, the LED 11*b* indicates the fact that the detected pitch matches the standard pitch, and the LED 11*c* indicates the fact that the detected pitch is higher than the standard pitch.

The operator that is used in the clean channel is the volume control 12*a* and the operators that are used in the lead channel are, the rotary switch 12*d*, the gain control 12*e*, and the volume control 12*f*. The other operators may be used in common in both the clean channel and the lead channel.

The volume control 12*a* sets the level of the volume of the clean channel and the volume control 12*f* sets the level of the volume of the lead channel. The rotary switch 12*d* selects the type of modeling in the lead channel and the modeling is set by means of the processing by the DSP 4 that simulates the timbre characteristics of the instrument and the reproduction amplifier for, for example, an electric guitar or an acoustic guitar and the like, which respectively correspond to each of the selection positions of model 1, model 2, etc. Incidentally, with regard to the rotary switch 12*d*, in those cases where the tuner function has been selected, which functions as an operator that designates the letter notation of an open string of the guitar. The string number and the letter notation of the open string of the guitar are indicated by the rotational position that is designated by the rotary switch 12*d*. Since the first string is tuned to the letter notation E, 1E is displayed and, in the same manner, 2B is displayed for the second string, 3G for the third string, 4D for the fourth string, 5A for the fifth string, and 6E for the sixth string. In addition, A♭ and A♭♭, with which irregular tuning is designated, are each displayed in two positions apart from these six positions.

The gain control 12*e* sets the amount of distortion. The bass control 12*g*, the mid-range control 12*h*, and the treble control 12*i* are arranged in the portion of the operating panel in which equalizer is displayed and these adjust the levels of the low register, the middle register, and the high register, respectively.

In addition, the effect control 12*j* is arranged in the portion of the operating panel in which the effect is displayed. Any effect such as chorus, flanger, phaser, and tremolo can be applied by means of the position of the control. Further, it is possible to set the degree of the effect by the position of the control.

In the same manner, the delay/reverb control 12*k* is arranged in the portion in which delay/reverb is displayed. The delay or reverb effect is applied by means of the rotational position of the control and, together with this it is possible to set the delay time or the volume of the reverb with the rotational position of the control.

Other than the operators described above, the input terminal 2, the foot switch terminal, into which the plug from the foot switch is inserted, and the recording out terminal, which is an output for recording use, are arranged on the operating panel.

The tuner button 12*c* is a switch that toggles the tuner function and the amplifier function. In those cases where the power switch 12*n* of the amplifier for a musical instrument 1 has been operated and the power turned on, the amplifier for a musical instrument 1 may be set to the amplifier function and can be switched to the tuner function when the tuner button 12*c* is pressed. The tuner button 12*c* is furnished with an LED that is built in; and, in those cases where the tuner function is selected, lights or blinks in conformance with the mode, which will be discussed later. In those cases where the amplifier function is selected, the LED is extinguished.

In the tuner function, there are a manual mode and an auto mode. When the tuner button is pressed for a short period of time (for example, shorter than one second) during the amplifier function, the tuner function is set to the manual mode.

When the tuner button 12*c* is pressed for a long period of time (for example, one second or more; hereinafter, referred to as "long pressing") during the amplifier function or during the manual mode of the tuner function, the tuner function is set to the auto mode. The LED that is built into the tuner button 12*c* is lit at the time of the manual mode, and blinked at the time of the auto mode.

In those cases where the tuner button 12*c* is pressed for a short period of time, no matter whether in the case of the manual mode or the auto mode, the amplifier returns to the amplifier function from the tuner function.

In the manual mode, the pitch that is designated using the rotary switch 12*d* is selected as the standard pitch. The pitch that is designated by the rotary switch 12*d* is stored in the guitar table 10*b* of the ROM 10. When the data that indicate the pitch that has been detected are input from the DSP 4 to the CPU 8, the CPU 8 makes a determination as to whether the pitch that has been detected is lower, matches, or is higher than the standard pitch that is set using the rotary switch 12*d* and in those cases where the pitch is lower, the LED 11*a*, which is positioned on the left side, lights, in those cases where the pitch matches, the LED 11*b* lights, and in those cases where the pitch is higher, the LED 11*c* on the right side lights. Incidentally, it may be set up such that the pitches are considered to match if in those cases where a determination is made as to whether or not the pitches match, the detected pitch is within a specified range of the standard pitch (for example, ±5 cents).

On the other hand, in the auto mode, the letter notation of the chromatic scale that is the closest to the detected pitch is selected as the standard pitch. Accordingly, the setting of the rotary switch 12*d* is ignored in the auto mode. The pitch that corresponds to the letter notation of the chromatic scale that is selected as the standard pitch is stored in the chromatic scale table 10*a* of the ROM 10. When the data that indicate the pitch that has been detected are input from the DSP 4 to the CPU 8, the CPU 8 extracts the pitch that is the closest to the pitch that has been detected from the chromatic scale table 10*a*, sets that pitch as the standard pitch, and makes a determination as to whether the detected pitch is lower, matches, or is higher than the standard pitch. In those cases where the pitch is lower, the LED 11*a*, which is positioned on the left side, lights, in those cases where the pitch matches, the LED 11*b* lights, and in those cases where the pitch is higher, the LED 11*c* on the right side lights.

Incidentally, in the auto mode, it may also be set up such that rather than selecting the letter notation of the chromatic scale that is the closest to the detected pitch, the pitch of the open string of a guitar that is the closest to the detected pitch is selected as the standard pitch. In those cases where the letter notation of the chromatic scale that is the closest to the detected pitch is selected as the standard pitch, after tuning once, it is possible to set different pitches a half tone at a time by visually confirming the lighting condition of the three LEDs while gradually changing the tension of the string. However, in those cases where the tuning is carried out by a beginner who is not used to tuning, a large change may be made in the tension of the string and the standard pitch will be changed from the target pitch. When the pitch of an open string of a guitar is selected as the standard pitch, the danger that a mistaken standard pitch will be selected is small since the difference from the pitch of the adjacent open strings is four to five half tones.

Figure 3:
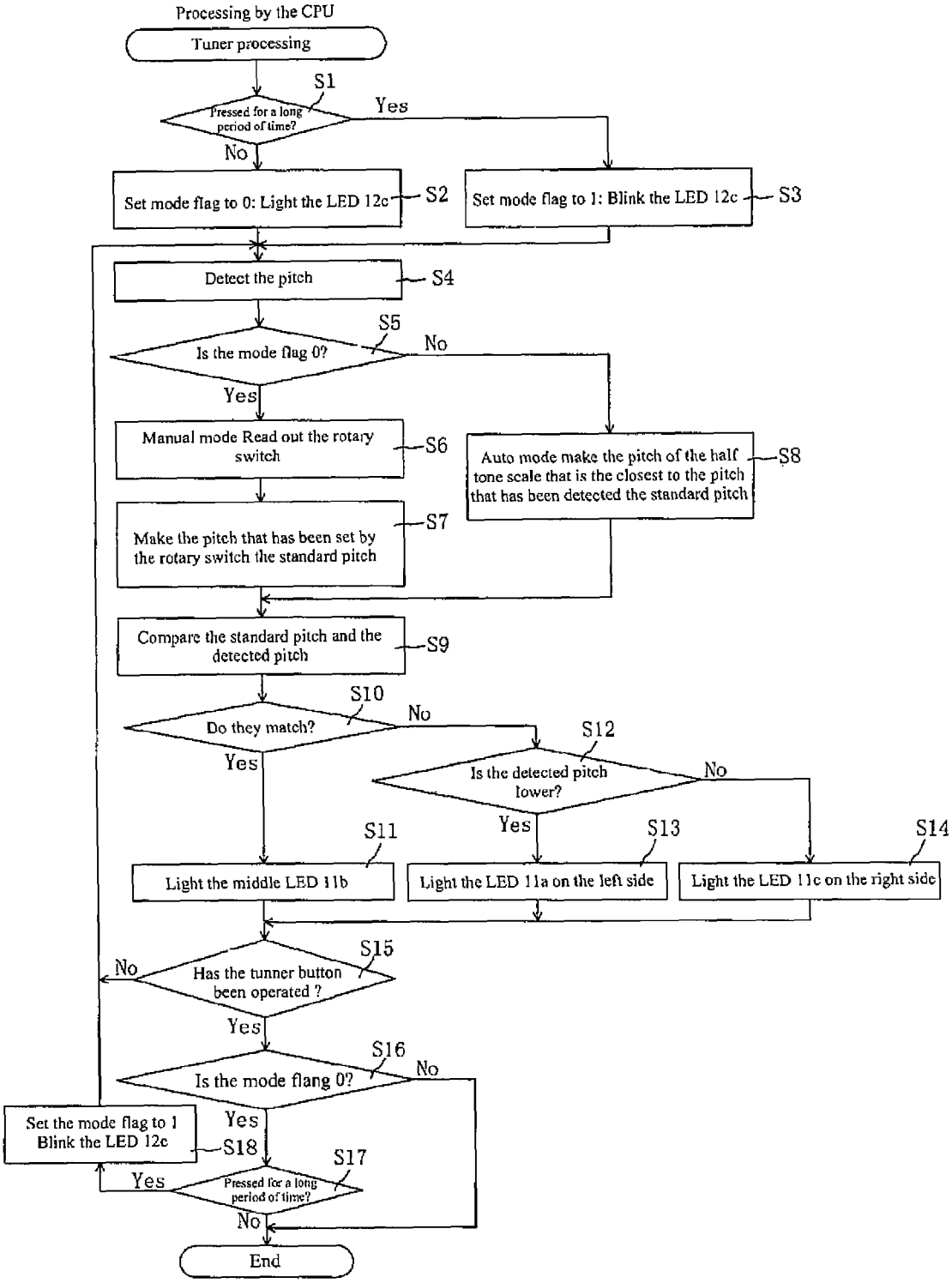
FIG. 3 is a flowchart that shows the tuner processing of an embodiment of the present invention.

Next, an explanation will be given regarding the tuner processing that is executed by the CPU 8 while referring to FIG. 3. FIG. 3 is a flowchart that shows the tuner processing according to an exemplary embodiment and this processing is launched when the user operates the tuner button 12*c* while in the amplifier function and is repeatedly executed until the tuner button 12*c* is operated again and the amplifier function is returned to.

In the tuner processing, first, a determination is made as to whether or not the tuner button 12*c* has operated with a long pressing (S1). In those cases where the button has not been operated with a long pressing (S1: no), the mode flag is set to "0" and the LED that is built into the tuner button 12*c* lights (S2). This mode flag is a flag that is stored in the RAM 23 and "0" and "1" indicate that the mode has been set to the manual mode and the auto mode respectively.

On the other band, in those cases where the tuner button 12*c* has been operated with a long pressing (S1: yes), the mode flag is set to "1" and it is set up the such that the LED that is built into the tuner button 12*c* is blinked (S3).

Next, the pitch of the input signal is detected based on the time interval of the generation of the zero cross that has been notified from the DSP 4 (S4) and, then, a determination is made as to whether or not the mode flag has been set to "0" (S5).

In those cases where the mode flag has been set to "0" (S5: yes), the unit has been set to the manual mode, so the position to which the rotary switch 12*d* has been set is read out (S6) and the pitch that is indicated by the rotary switch is selected as the standard pitch (S7). This standard pitch has been stored in the guitar table of the ROM 10 corresponding to the position to which the rotary switch 12*d* has been set.

On the other hand, in those cases where, in the determination processing of S5, the mode flag has been set to "1" (S5: no), the unit is set to the auto mode, so the pitch of the chromatic scale that is the closest to the pitch that has been detected is selected from the chromatic scale table that has been stored in the ROM 10 and that pitch is made the standard pitch (S8). Incidentally, the standard pitch that has been selected in S7 or S8 may be stored in the RAM 9 and it may also be set up such that the address in the table in which the standard pitch has been stored is stored in the RAM 9.

When the standard pitch has been selected by the processing of S7 or S8, then, the standard pitch and the pitch that has been detected are compared (S9) and in those cases where the pitches match (S10: yes), the middle LED 11*b* lights (S11), in those cases where the detected pitch is lower (S10: no and S12: yes), the LED 11*a* on the left side lights (S13), and in those cases where the detected pitch is higher (S10: no and S12: no), the LED 11*c* on the right side lights (S14). Incidentally, in those cases where any one of the three LEDs has been lit, the other two LEDs are extinguished. In those cases where the processing of S11, S13, or S14 has completed, a determination is made as to whether or not the tuner button 12*c* has been operated (S15). In those cases where the tuner button 12*c* has not been operated (S15: no), the routine returns to the processing of S4 and in those cases where the tuning button 12*c* has been operated (S15: yes), a determination is made as to whether or not the setting of the mode flag is "0" (S16).

In those cases where the mode flag has been set to "0" (S16: yes), the unit is set to the manual mode, so a determination is made as to whether or not the tuning button 12*c* has been operated by pressing for a long period of time (S17). In those cases where the mode flag has not been set to "0" (S16: no), the unit is set to the auto mode, so the tuner function ends and the unit returns to the amplifier function.

In those cases where the tuning button 12*c* has been operated with a long pressing (S17: yes), since this is an instruction to change to the auto mode from the manual mode, it is set up such that the mode flag is made "1" and the LED that is built into the tuning button 12*c* is blinked (S18), and the routine returns to the processing of S4.

As has been explained above in regards to the manual mode, the tuning is carried out by designating one of the pitches of an open guitar string as the standard pitch. Similarly, in the auto mode, it is possible to select the pitch of the chromatic scale that is the closest to the pitch that has been detected or the pitch of an open string of a guitar as the standard pitch and carry out the tuning. Therefore, in those cases where the string is restrung, the standard pitch is selected and the tuning done in the manual mode; and, in the case of the following tunings, it is possible to carry out the tuning in the auto mode with a display that only indicates low, matching, and high. Accordingly, it becomes unnecessary to have a display device that displays the standard pitch that has been selected in the auto mode, the tuning system of the present invention can be installed even in those cases where there is no space for the installation of a display device, and, together with this, it is possible to provide a tuner system and an amplifier for a musical instrument that has been furnished with a tuner function at low cost.

An explanation was given above regarding the present invention based on a preferred embodiment but the present invention is not in any way limited to the preferred embodiment that has been discussed above and the possibility of various modifications and changes that do not diverge from and are within the scope of the tenor and purport of the present invention can be easily surmised.

For example, in this preferred embodiment, it has been set up such that the ROM 10 is furnished with a chromatic scale table and the like that stores the pitches (the frequencies) that correspond to each scale of the chromatic scale but it may also be set up such that the pitches of the chromatic scale are calculated using an operational expression and with regard to the storage of the pitches having a specified interval and the chromatic scale of the interval of the pitches that have been stored, it may also be set up such that these are derived by calculation.

In addition, in the preferred embodiment described above, with regard to the setting of any pitch desired (for example, an A at 440 Hz) to be the standard for the tuning, although it is not mentioned, it may also be set up such that the scale that is set may be any scale desired selected from those such as an equal temperament, a just intonation, an Arabian scale, and the like.

In addition, in the preferred embodiment described above, it has been set up such that the tuner function is incorporated in the amplifier for a musical instrument; but the tuner function may also be incorporated in another electrical device such as an electric musical instrument and the like and it may be an independent tuner system that is not incorporated in an electric musical instrument or an electronic musical instrument and the like.

In addition, in the preferred embodiment described above, it has been set up such that the rotary switch 12*d* is one that, in the amplifier function, selects the type of modeling that simulates the timbre characteristics of a musical instrument and a reproduction amplifier but it may also be set up such that the switch selects the type of control that changes the frequency characteristics of the input signal or that selects the effect that is applied to the input signal.

What is claimed is:

1. An amplifier for a musical instrument, the amplifier comprising a tuning device, the tuning device comprising:

input means configured to accept an electrical signal;

pitch detection means configured to detect the pitch of the electrical signal;

manual pitch designation means configured to designate any of the pitches that make up the musical scale as a standard pitch;

auto pitch designation means configured to designate as a standard pitch, the pitch from among the pitches that make up the musical scale that is closest to the pitch of the electrical signal;

mode selection means configured to select either a manual mode or an auto mode, wherein in the manual mode the standard pitch is designated by the manual pitch designation means, and wherein in the auto mode the standard pitch is designated by the auto pitch designation means;

comparison means configured to compare the pitch of the electrical signal and the standard pitch; and display means configured to display the results of the comparison by the comparison means, wherein the display means is further configured such that when the standard pitch is designated by the auto pitch designation means, the standard pitch is not displayed, the amplifier further comprising:

a function selection means for selecting from either a tuner function that detects the pitch of the electrical signal or an amplifier function that amplifies, processes and outputs the electrical signal; and at least one operator that manages the settings of the tuning, wherein upon selection of the tuner function by the function selection means, the operator designates the standard pitch as the manual pitch designation means; and wherein upon selection of the amplifier function by the function selection means, the operator sets the type of timbre control for the electrical signal that has been input in the input means.

2. The amplifier according to claim 1, wherein the at least one operator sets the type of control that modifies the frequency characteristics of the electrical signal when the amplifier function is selected.

3. The amplifier according to claim 1, wherein the at least one operator sets the type of modeling that simulates the timbre characteristics of the instrument or the reproduction amplifier for the electrical signal when the amplifier function is selected.

4. The amplifier according to claim 1, wherein the at least one operator sets the type of effect that is applied to the electrical signal when the amplifier function is selected.

5. An amplifier for a musical instrument, the amplifier comprising a tuning device, the tuning device comprising:

an input terminal configured to receive an input electrical signal;

a pitch detector operatively connected to the input terminal to detect a pitch of the input electrical signal;

a manual pitch designator configured to designate a standard pitch from a plurality of pitches of a scale;

an automatic pitch designator configured to designate a standard pitch as a pitch from a plurality of pitches of a scale that is closest to the pitch of the input electrical signal;

a mode selector configured to select either a manual mode or an auto mode, wherein in the manual mode the standard pitch is designated by the manual pitch designator, and wherein in the auto mode the standard pitch is designated by the automatic pitch designator;

a pitch comparator configured to compare the pitch of the input electrical signal and the standard pitch; and a display device configured to display the results of the comparison of the pitch comparator, wherein the display device is further configured such that when the standard pitch is designated by the automatic pitch designator, the standard pitch is not displayed, the amplifier further comprising:

a function selector configured to select from either a tuner function that detects the pitch of the electrical signal or an amplifier function that amplifies, processes and outputs the electrical signal; and at least one operator that manages the settings of the tuning, wherein upon selection of the tuner function by the function selector, the operator designates the standard pitch as the manual pitch designator; and wherein upon selection of the amplifier function by the function selector, the operator sets the type of timbre control for the electrical signal that has been input in the input terminal.

6. The amplifier according to claim 5, wherein the at least one operator sets either: (1) the type of control that modifies the frequency characteristics of the electrical signal when the amplifier function is selected, (2) the type of modeling that simulates the timbre characteristics of the instrument or the reproduction amplifier for the electrical signal when the amplifier function is selected, or (3) the type of effect that is applied to the electrical signal when the amplifier function is selected.

* * * * *